United States Patent [19]

Thayer et al.

[11] Patent Number: 4,822,292

[45] Date of Patent: Apr. 18, 1989

[54] MULTIPLE LINE CIRCUIT TRACK LIGHTING SYSTEM AND FIXTURE MOUNTING ADAPTERS THEREFORE

[76] Inventors: George F. Thayer, 2503 Greenbrier, Anahiem, Calif. 92801; Jack V. Miller, 700 N. Auburn Ave., Sierra Madre, Calif. 91024

[21] Appl. No.: 5,919

[22] Filed: Jan. 21, 1987

Related U.S. Application Data

[63] Continuation of Ser. No. 688,256, Jan. 2, 1985, abandoned.

[51] Int. Cl.[4] ..... H01R 25/14

[52] U.S. Cl. ..... 439/207; 439/115

[58] Field of Search ..... 439/110, 207, 209

[56] References Cited

U.S. PATENT DOCUMENTS

| | | | |
|---|---|---|---|
| 3,559,146 | 10/1968 | Valtonen | 339/21 S |
| 3,757,273 | 9/1973 | Hesse | 339/21 R |
| 3,760,133 | 9/1973 | Howard | 439/119 X |
| 3,980,368 | 9/1976 | Fremont | 339/21 R |
| 4,053,194 | 10/1977 | Gilman | 439/115 |
| 4,508,400 | 4/1985 | Herbert | 439/207 |

*Primary Examiner*—Eugene F. Desmond

*Attorney, Agent, or Firm*—John E. Wagner

[57] ABSTRACT

A multiple circuit track lighting system comprises a track carrying electrical conductors and a connector mechanically engageable with the track for support and for supporting a lighting fixture. The connector is rotatable with respect to the track to effect an electrical connection between it and either of two electrical circuits carried by the track and is releasably latched in either positon.

13 Claims, 5 Drawing Sheets

Fig. 1
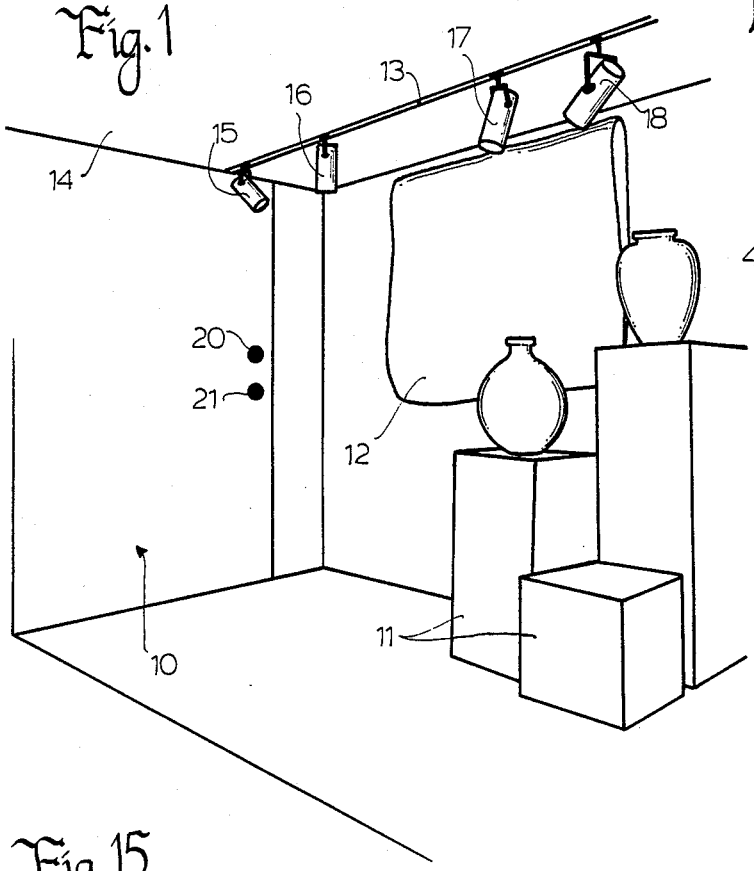
Fig. 3
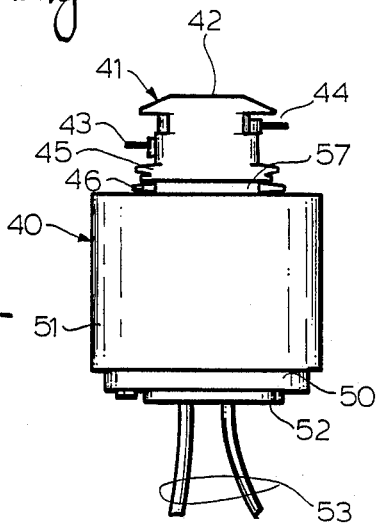
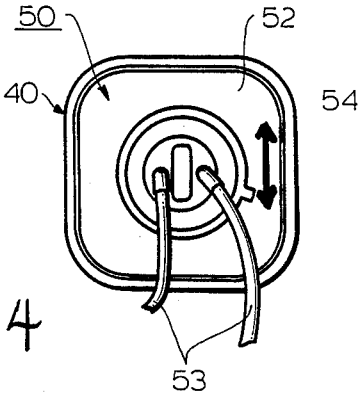
Fig. 4
Fig. 15
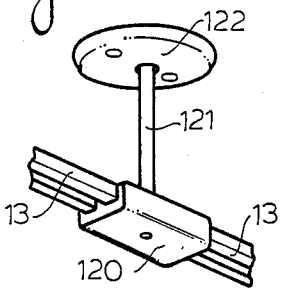
Fig. 2A
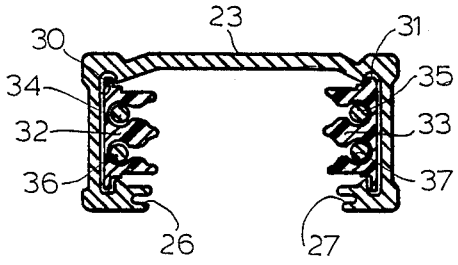
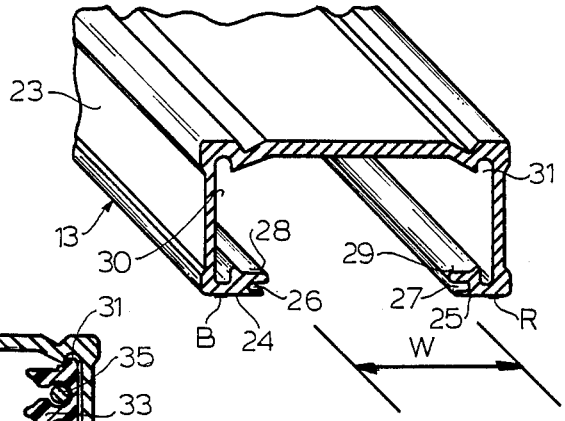
Fig. 2

MULTIPLE LINE CIRCUIT TRACK LIGHTING SYSTEM AND FIXTURE MOUNTING ADAPTERS THEREFORE

This is a continuation of application Ser. No. 06-688,256 filed Jan. 2, 1985, now abandoned.

BACKGROUND OF THE INVENTION

Throughout recent years in the lighting industry there has been a definite trend and development in the field known as "track lighting". This involves the use of a track which is either recessed into a ceiling surface or suspended below such a surface and extends across the greater or entire length of a room. The track usually includes a longitudinal central recess in which electrical conductors are insulatingly positioned. Special connector members are designed which may be inserted into the recess in the track, usually turned 90 degrees to lock them in place, and in doing so make electrical contact with the conductors. The connector or adapter may be coupled to any of a variety of types of lighting fixtures.

The principal advantage of track lighting is that lighting fixtures may be located at any place along their length and after being installed, may be removed and replaced with different lighting fixtures or may be moved along the length of the track to the desired location. This type of system has been particularly useful in commercial, retail and window display applications where the points of desired lighting and direction of lighting may change as displays change, and track lighting affords this high degree of flexibility. Also the track itself is not obstrusive into the scene and in fact can be quite attractive. It is usually formed of anodized aluminum formed by extrusion.

Representative patents showing track lighting systems are: U.S. Pat. Nos.

| | | | |
|---|---|---|---|
| | 2,977,566 | M. Neumann et al | Mar. 28, 1961 |
| | 3,894,781 | A. C. Donato | Jul. 15, 1975 |
| | 4,289,365 | H. J. Rutgers | Sep. 15, 1981 |
| | 3,737,834 | J. Contrallo | June 5, 1973 |
| and | 3,832,503 | R. B. Crane | Aug. 27, 1974. |

More recently track lighting systems have been applied to residential applications affording the same degree of flexibility. It has been found however that in both commercial and residential applications, there is a desire for a relatively fixed location for the fixtures after they are installed, but a degree of flexibility in the lighting effects achieved. This may be accomplished in part by the use of dimmer switch controls which allow the user to control the light intensity on the scene. More recently, it has been the desire of commercial and residential users to have more than one circuit in a single track light system allowing two independent controls for two different sets of lights on a single track. Either or both may be dimmer controlled for additional flexibility. An auxiliary advantage of having dual circuits is that the danger of overload of a single circuit is reduced by the presence of two circuits, and directions to use part of the lighting fixtures on one circuit and part on the other circuit.

Accomplishing these ends in a single track, which is reliable, safe and has no danger of misconnection or short circuiting, has heretofore escaped lighting designers.

BRIEF DESCRIPTION OF THE INVENTION

Faced with this state of the art, we have set about to design a two circuit track lighting system including a track, adapters, connectors and power feeds which in fact provide reliable, foolproof, two circuit performance, all within a structural size which is commensurate with existing single track systems, and in fact superior to single track systems in several respects in addition to the dual circuit feature.

First, we have produced a track which houses two pair of electrical conductors defining two independent electrical circuits in opposite reversed vertical array on the opposing sides of the track; i.e. two conductors in vertical array on one side of the track and two on the other. The upper conductor on one side and the lower conductor on the opposite side define one circuit and the lower conductor on the first side with the upper conductor on the second side define the other circuit. We term this arrangement bilateral assymetry. Supporting the conductors in the correct insulated position within the track insulating barriers will prevent inadvertent contact with conductors of the two different circuits. The track defines a pair of matching grooves at the lower extremity in which mechanical support for any fixture is provided as well as electrical ground for both circuits.

A typical fixture adapter for use with the track of this invention includes a body and an insulating pillar dimensioned to enter the recess between the conductors, and a 90 degree turn, allows the contacts of the pillow to engage the conductors of a single circuit. the body of the adapter includes outward extending flanges which enter and engage the groove in the track.

The presence of dual circuits, which must be isolated from themselves and from ground, presented a need for a power connector for the ends of the track. While maintaining the dimensional restriction of the track size substantially the same as the other circuit, the application of power to the track presented significant difficulties. This was overcome by a power connector which includes a housing defining a recess for receiving a double winged neutral contact extending out of the housing in position to engage both of the uppermost conductors, i.e. the common neutral conductors of the track. A center barrier defines the neutral contact except for an exposed contact screw receiver and the wing contacts. The center barrier isolates and positions a pair of independent wing contacts on opposite sides of the neutral contact and isolated therefrom, which provide the individual hot line contacts to the two circuits. A cover encloses the lowermost portion of the power connector and also secures a double wing ground contact within the power connector. A ground strap on the exterior of the housing engages the double winged ground contact by means of a rivet which secures the entire assembly together. One of the mounting screws for the power connector extends through the ground strap. Therefore, in the contact power connector the functions of grounding, neutral connection to two circuits and independent line circuits are all provided and clearly electrically isolated from each other.

Owing to the presence of two independent circuits in the same track, the extension of power while maintaining independence of the two circuits from track segment to track segment is much more difficult in this case than in the case of a single circuit. Therefore, we have found it necessary to design a connector which joins the ends of tracks and maintains the proper circuit integrity without any danger of cross or short circuiting or incorrect installation. This we have accomplished in our track connector.

Although the powering of a track lighting system from the end is most common, situations often exist when remodel facilities use a drop ceiling with existing wiring is already in place from the ceiling, and no end electrical connections are available or practical. This problem becomes even more significant in the case of a dual circuit installation. We have faced and solved this problem through the use of a floating canopy connector utilizing the basic lighting adapter technology to provide isolated electrical input to the track any place along its length for the two independent circuits. Although electrical connection to the track system is made below the track, it is totally concealed from view and requires no alteration of the track whatsoever.

The floating canopy electrical connection is accomplished employing a pair of tower members captured within a single elongated insulating plate and captured in the plate for 90 degree rotation from an unlocked to a locked position. The two adapters are each rotatable in a single direction and return only when each are moved into a locked position. They each engage the neutral line and one line conductor. Spade lugs are provided for electrical connection to the adapter. An attractive cover conceals any electrical wiring from the spaced connectors to the above ceiling area. The two towers have contacts polarized such that on turning from an unlocked to a locked position, they can each only engage the different line. The towers in this case include integral tabs for mechanically securing the assembly to the track and no mechanical weight load is applied to the electrical contacts.

In accordance with this invention, the user need only refer to the distinctive marks located on the opposite sides of the track, for example, a blue stripe on one side and a red stripe on the opposite, and to the adapter in hand. If he installs the adapter when turned to a locked position and has an arrow aligned with the blue stripe electrical fixture attached to the adapter is powered by the "blue" circuit. If the user removes the adapter, reverses it, i.e. turns it 180 degrees, reinserts the adapter in the track and turns it to a locking position in which the indicator on the adapter now corresponds to the red stripe, the fixture attached to the adapter, will be powered by the "red circuit. This way, the user may balance the load and create the precise effects which he wants. By merely walking the length of the area illuminated by this invention, the user can immediately determine which fixtures are on which circuit, and can either reposition movable fixtures on their own pivots or movable features, and move the entire fixture any place along the track, and can control the intensity of the light provided via a dimmer if the circuit provides dimming capability and can switch the fixture from one circuit to another by mere reversal of the adapter in the track. Never before has the use of track lighting had the degree of control and versatility than is afforded by this invention. Likewise, power control and load balancing is easily achieved employing this invention.

BRIEF DESCRIPTION OF THE DRAWING

This invention may be more clearly understood from the following detailed description and by reference to the drawing in which:

FIG. 1 is a fragmentary perspective view of a business display area employing this invention;

FIG. 2 is a perspective view of a section of the track of FIG. 1;

FIG. 2A is a vertical sectional view of a section of track;

FIG. 3 is a side elevational view of an adapter of the type usable in the track of FIGS. 1 and 2;

FIG. 4 is a bottom plan view of the adapter of FIG. 3;

FIG. 15 is a perspective view of a power suspension assembly in accordance with this invention.

DETAILED DESCRIPTION OF THE INVENTION

Figure 7:
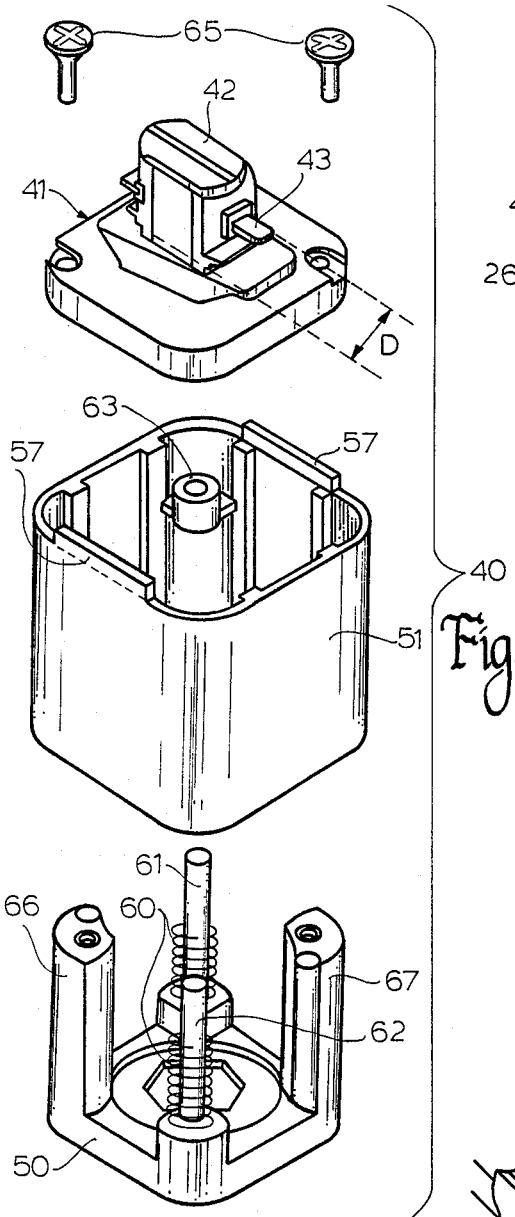
FIG. 7 is an exploded view of an adapter in accordance with this invention.

Now referring to FIG. 1, in which a commercial retail scene employing this invention is illustrated, a show room or window display generally designated 10 includes a number of objects of interest displayed on stands backed by background material 12. Lighting for the entire display is developed from the track 13 in the ceiling 14. The track 13 mounts a number of cylindrical fixtures 15–18, each supported by their respective cradles which allow them to be pivoted through approximately 350 degrees of azimuth and 200 degrees in elevation. Thus, the fixtures 15–18 may be directed throughout the entire work area but, more particularly, certain ones may be directed towards the primary objects of interest on the pedestals 11 in the foreground, and others may be directed toward the background 12. This is a classic application for a track system of this invention in which lamps 16 and 18 as they are shown, are used to illuminate the background and lamps 15 and 17 are directed toward the foreground objects. The most attractive display exists when the balance between the lighting of the foreground objects and the background is correct in the eyes of the display designer. This is accomplished employing this invention and dimmer switches 20 and 21 associated with respective track circuits.

Figure 6:
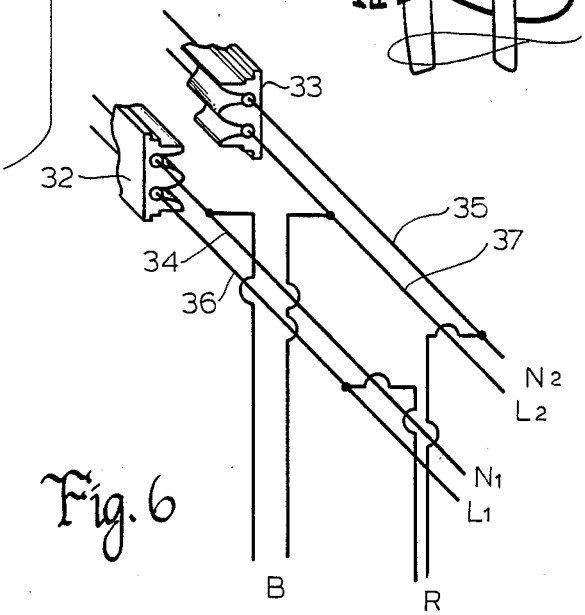
FIG. 6 is a simplified electrical schematic of this invention.

Basic element of this invention is the track 13 shown in FIG. 2 as including a body or extrusion member 23 in the shape of an open bottom box with enlarged lip regions 24 and 25 defining longitudinal grooves 26 and 27. These grooves 26 and 27 provide mechanical support for any fixtures secured to the track 13. Secondary lips 28 and 29 define a pair of internal cavities 30 and 31 which receive extruded plastic insulators 32 and 33 of FIG. 2A which define two recesses for receiving electrical conductors 34, 35, 36 and 37 which define the two circuits. An examination of FIG. 6 in conjunction with FIG. 2A shows the conductors 34 and 35, the uppermost conductors, which constitute an electrical neutral and with conductor 36 defines line 1 and with conductor 37 constitutes line 2. A first circuit identified for convenience as the "blue" circuit is made up of the neutral conductor 34 and line 2, conductor 37. The second or "red" circuit employs the neutral conductor 35 on the right and the line 1 conductor 36 on the left. That is the lowermost conductor on the left and the uppermost conductor on the right constitute one circuit and the lowermost conductor on the right with the uppermost conductor on the left constitute the second circuit. This is termed bilateral assymetry which allows simple reversal of any fixture to automatically change the line to which it is connected. In FIGS. 2A and 6 these are identified as the R and B circuits. At the bottom of the track 13 on the faces 24 and 25 there are located painted strips, blue and red exposed from the bottom side of the track but hardly noticeable. These denote the blue circuit and the red circuit and, with the arrow 54 (FIG. 4) inform the observer as to which circuit any particular fixture is connected.

Now refer to FIGS. 3 and 4 for an understanding of the adapter used in conjunction with the track of FIG. 2. In FIG. 3, the track adapter 40 will be seen including a power connector 41 including a tower 42 of insulating material which positions a pair of spring loaded contact members 43 and 44. It should be noted that the spring loaded contact members 43 and 44 are at different elevations. At the bottom of the tower 42 there is a flange 45 on each side of the tower which is located immediately above a locking wedge 46 which forms a part of the adapter body 50 immediately above a track adapter housing 51. The track adapter body 50, likewise may be seen extending slightly out of the bottom of the housing 51. Emerging from a central opening in a bottom plate 52 of the track adapter body 50 are a pair of conductors 53 which supply current derived from the track through contacts 43 and 44 to any fixture secured to the bottom of the track adapter 40. It should be noticed in FIG. 4 that the track adapter 40 is generally rectangular in shape although it may take other shapes such as round, triangular or square if desired. Notice that on the bottom plate 52 in FIG. 4 is a double-ended arrow 54. This double-ended arrow is preferably cast into the track adapter body 50 and appears on one side only of the track adapter. It is positioned on the same side as the uppermost contact 44 of FIG. 3. Double-ended arrow 54 acts as the indicator in the track adapter directing attention to the indicator stripe, either "blue" or "red" on the track of FIG. 2.

Referring again to FIG. 3 in connection with FIG. 7, the housing 51 is spring loaded upward in the position shown and includes an upper tab 57 corresponding in width to the track opening W so that the housing 51 snaps into the opening in track 13 when the adapter 40 is properly seated, both electrically and mechanically in the track. The tabs 57 and the spring loading produced by spring 60 on columns 61 and 62, the tops of spring 60 bear against the underside of a pair of guides and stops, one of which 63 appears in FIG. 7. The track adapter is held together by a pair of machine screws 65 engaging mating threads in opposite corner columns 66 and 67.

In FIG. 7, it is particularly noticeable that the tower 42 is elongated and it has a dimension D which is slightly less than the width of the track opening W of FIG. 2. This allows the adapter 40 to be slipped in, with the tower positioned in one direction only and thereafter rotated 90 degrees. The contacts 43 and 44 are brought into engagement with the appropriate conductors and the wedge shaped mechanical locks 46 of the connector assembly 41 are allowed to engage the locking slots 26 and 27 of the track 13 as shown in FIGS. 2 and 2A. Thus, the connecting assembly provides mechanical locking of the adapter 40 to the track 13 and grounding of the adapter to the track as well as electrical connections of the vertically displaced contacts 43 and 44 with two of the conductors within the track, one of the conductors a common conductor 36 or 37 and one of the other a line conductor 34 or 35.

Figure 5:
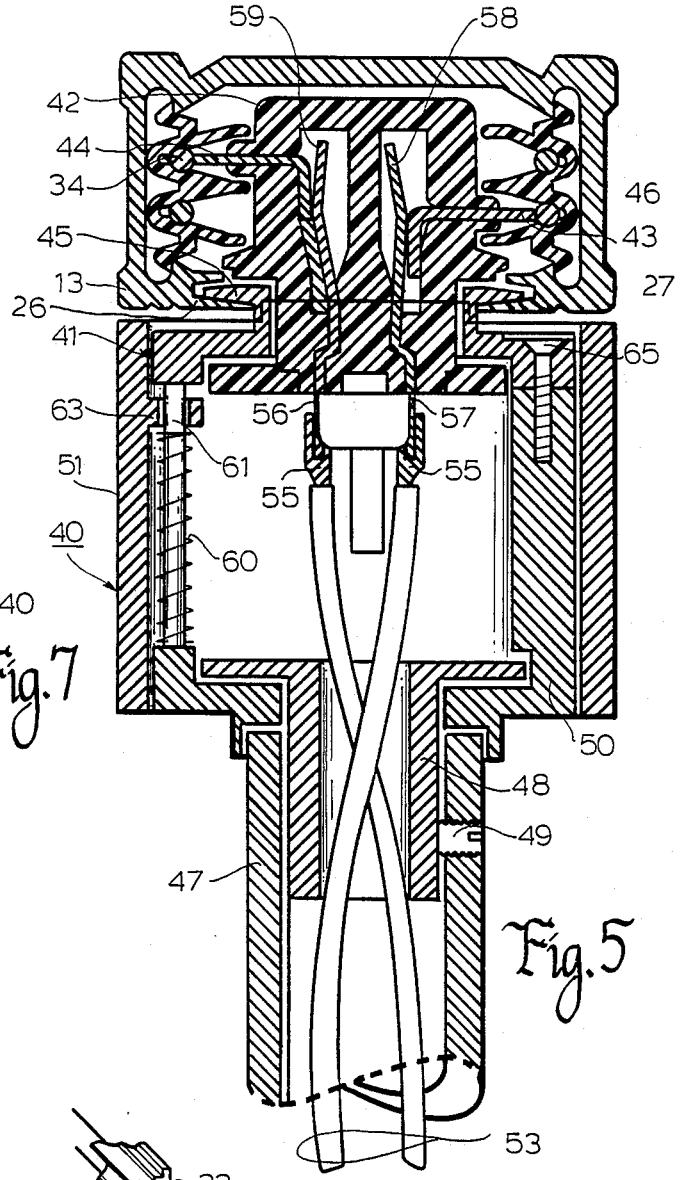
FIG. 5 is a vertical sectional view through a track and adapter assembly employing this invention.

The details of the tower and its electrical contacts as well as the electrical connections as just described may best be seen in the sectional view of FIG. 5.

TRACK AND ADAPTER ASSEMBLED

For a better understanding of the interrelationship between 2 and 2A and a typical adapter 40 as illustrated in FIGS. 3, 4 and 7, reference is now made to FIG. 5. In FIG. 5, a track 13 is shown in its installed position with the opening between the track of Figs. the outer lip regions 24 and 25 defining a body opening which is now filled with the tower 42 of a track adapter 40. The locking wedges 45 and 46 are fully seated in the grooves 26 and 27 respectively, thereby providing positive mechanical support for the adapter 40 and its fixture which, in this case, is supported by a tube 47 secured in a bottom flange 48 by a set screw 49. Conductors 53 terminate in spade lug receptacles 55. The receptacles 55 engage spade lugs 56 and 57 at the bottom of spring contact members 58 and 59 which are wedged in a cavity and bear against spring contacts 43 and 44 respectively. The spring contacts 58 and 59 allow the L shaped contacts 43 and 44 to retract as they are brought into engagement with the conductors 34 and 37 respectively while maintaining spring bias against those conductors for effective electrical contact. The spring contact parts 58 and 44 may be manufactured as an integral part as may the part 59 and 44. In such case, the length of the legs of the parts 58 and 59 would necessarily be different to accommodate the difference in vertical position of the contacts 43 and 44 which constitute the fundamental aspect of this invention. In the form shown in FIG. 5, contacts 58 and 59 are identical spring parts as are parts 43 and 44 thereby simplifying inventory and assembly. Note in FIG. 5 that the spring contacts 43 and 44 are asymetrically placed, namely, the spring contact 43 is at a lower position with respect to the bottom opening of the track than is contact 44. The tower 42 limits the upper movement of the track adapter 40 so that the track adapter may not be inserted too far into the track and misconnect the contacts.

Similarly, the track adapter 40, if only partially inserted into the track, will not assume the locked position shown in FIG. 5 but rather will turn 180 degrees instead of 90 degrees to a locked position and release.

END POWER FEEDER

Figure 8:
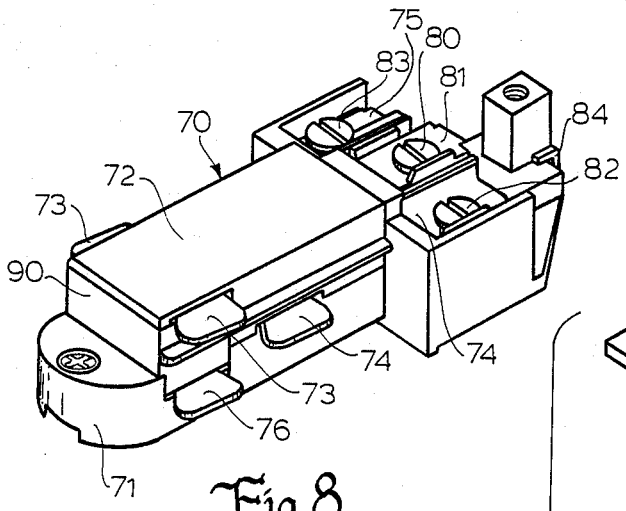
FIG. 8 is a perspective view of a power connector of this invention inverted from its operating position.
Figure 9:
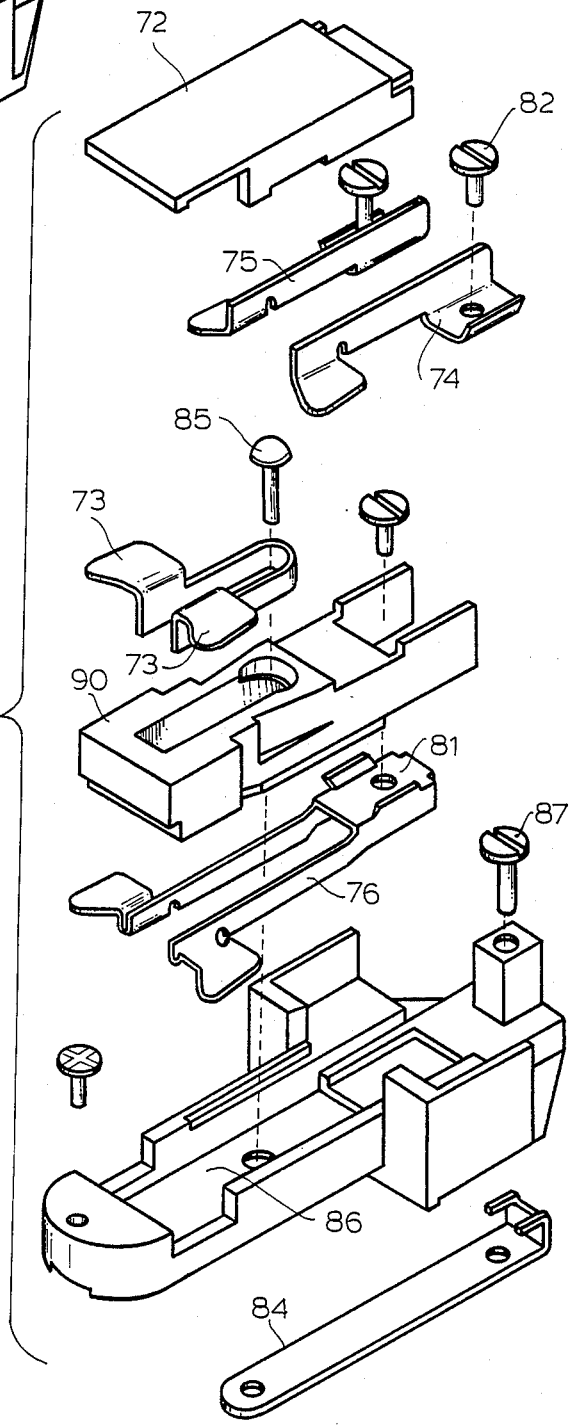
FIG. 9 is an exploded view of the power connector of FIG. 8.

In order for the track lighting system of this invention to operate, it is essential that the two distinct circuits be appropriately fed with power and that the track itself be grounded. The most common way of feeding track lighting systems which are being newly installed is to supply power through an end connector which enters the end of a track section. Such an end connector 70 is shown in FIGS. 8 and 9, to which reference is now made. The end connector 70 in accordance with this invention is significantly more complex than in the case of typical connectors which are required to feed one circuit only. In this case not only must two circuits be fed but a neutral ground maintained and effective separate ground connection to the track must also be made.

The end connector 70 of this invention includes an insulating body or housing 71 with an upper cover 72 enclosing a pair of wing shaped ground contact wings 73 which, as may be seen in FIG. 9, are a part of a unitary generally U shaped spring member.

Referring again to FIG. 8, a pair of power contacts 74 and 75, the latter of which is best seen in FIG. 9, extend outward to the side of the housing 71. A neutral contact 76 includes a pair of wings, one of which may be seen in FIG. 8 extending through a slot defined by the housing 71 and an insulating barrier 90 best seen in FIG. 9. The wings of the neutral contact 76 are located at the same vertical level and at different vertical levels from the left and right power contacts 74 and 75 and the ground contact wings 73. This vertical displacement of the contacts insures isolation of the separate circuits and insures proper powering of the separate circuits. At the rear or outer end of the power connector 70 may be seen three electrical contact screws 80, 82 and 83. Screw 80 is threaded into the flange portion of neutral contact 76. Screw 82 engages a flange portion of the left hand power contact 74 while the screw 83 engages the flange portion of right hand power contact 75. Underlying the housing 71 and only slightly visible to the right hand FIG. 8 but shown in its totality in FIG. 9 is the ground strap 84 secured to the housing 71 by screw 87 which passes through the rear end of housing 71 and threadably engages an opening at the rear of ground strap 84. The ground connection for the system is made through screw 87.

The assembly of the end connector 70 involves the running strap 84 positioned at the under side of housing 70, screw 87 to hold the strap 84 in place and the neutral contact 76 snapped into the central groove of housing 71 with its two wing contacts emerging from the side grooves of the housing 71. The barrier 90 is contoured to overlay the neutral contact 76 except for the side wings and the end flange portion 81. The barrier 90 includes an elongated recess into which the ground contact spring 73 is placed with the wing portions extending laterally. The left hand and right hand power contacts 74 75 are positioned beside the barrier 90 with their end flanges located on the rear platforms of the housing 71. A single rivet 85 holds the ground contact 73, the barrier 90, the housing 71 and the ground strap 84 together as a single unit and makes electrical contact between the ground strap 84 and the ground contact 73. The housing cover 72 covers the rivet 85 and ground contact 73. By the connection of each of these parts, a ground connection is made to the end connector 70 and via strap 84, rivet 85 and via the grooves 26 and 27 to the track 13 as shown in FIG. 2A. The two wings of the neutral contact 76 are positioned uppermost vertically when in peace so that they engage the conductors 34 and 35 of FIG. 2A, establishing these two upper conductors as the neutral for the two circuits. Since each of the side wings acting as electrical contact to the track and the conductors are located at different vertical positions and the two power conductors being asymmetrically located on a side by side basis, effective electrical contact and isolation is achieved for end power feeding.

TRACK CONNECTORS

Since track extrusions come in finite lengths, some of which are shorter than the length of a single run of track, there is a need for an electrically effective and reliable properly polarized track connector. Such a connector 100 may be seen in FIGS. 10 and 11. The track connector 100 is designed to be inserted ½ into the end of one track section and the other half into the mating end of the next track section. Essential to the successful operation of the system is that the two circuits be continuously connected throughout the track length and that they be effectively isolated from each other and that system ground be reliably connected from track section to track section. These are all accomplished employing the track connector 100 of FIGS. 10 and 11.

Figure 10:
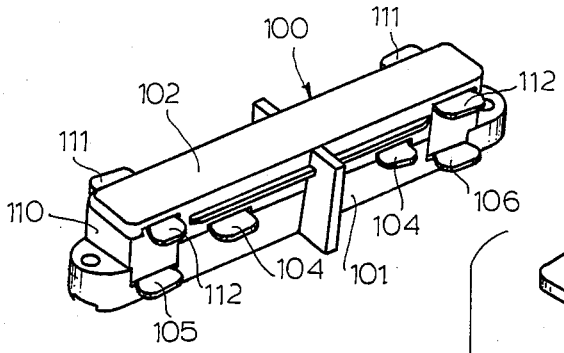
FIG. 10 is a perspective view of the track interconnector of this invention.
Figure 11:
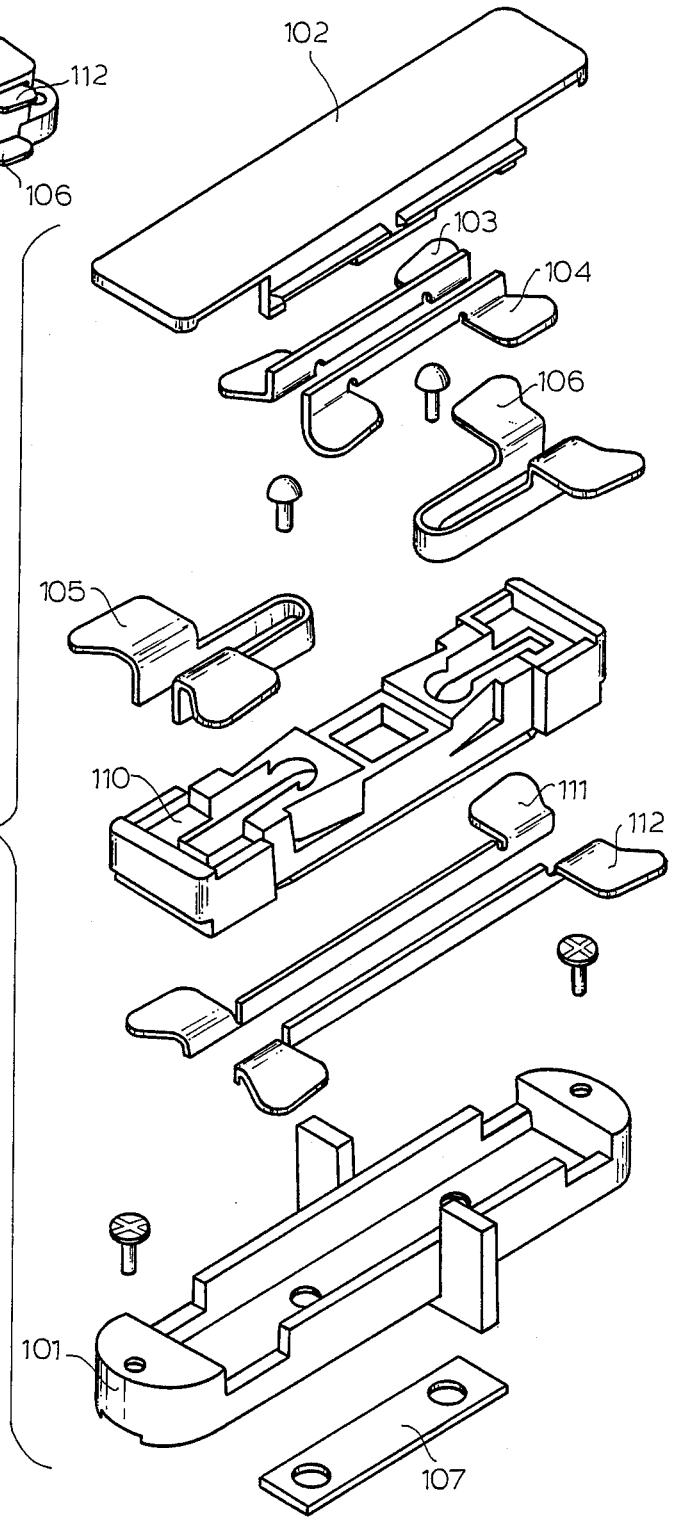
FIG. 11 is an exploded view thereof.

Now referring to FIGS. 10 and 11, the track connector 100 comprises a housing 101 closed by a cover 102 with a pair of power contacts 103 and 104 positioned about midway vertically in the housing 101 and each having a pair of wings which extend out of lateral openings on the same side of the track connector 100. By this arrangement conductors in adjoining tracks at the same level and the same side are interconnected and isolated from conductors on the opposite side or at a different level. A pair of ground contacts 105 and 106 similar to the ground contacts 73 of FIG. 9 are positioned within a center barrier 110 in respective recesses with side wings extending out through side openings in the housing 101 and barrier 110. These ground connectors 105 and 106 are each held in place and mechanically and electrically secured to a grounding strap 107. This way the electrical ground is effectively transferred between adjacent track ends.

Similarly a pair of double winged power contacts 103 and 104 interconnect lines 1 and 2, namely the uppermost conductors in the track of FIG. 2A to the conductors of the adjacent track section.

Neutral contacts 111 and 112 each include a pair of side wings which extend out through openings in the housing 101 below the barrier 110 and transfer the neutral connection between the uppermost conductors in the track 13 of FIG. 2A. In FIGS. 10 and 11, the track connector 110 is illustrated inverted from its normal installed position. The arrangement of FIGS. 10 and 11 insures that the ground neutral and two power conductors from adjacent tract sections are interconnected and the conductor integrity is maintained. There is no danger of cross connections between the two circuits, the blue circuit and the red circuit, through the connector 100.

FLOATING CANOPY

Figure 12:
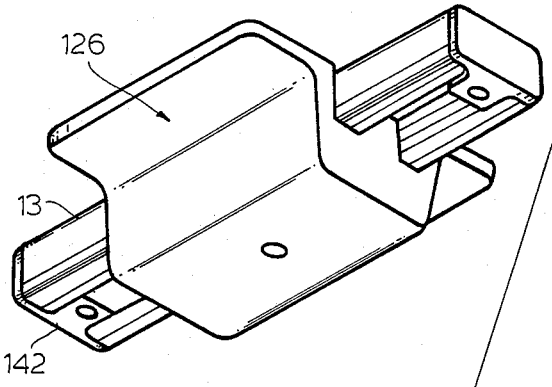
FIG. 12 is a perspective view of a floating canopy in accordance with this invention.

Often in remodeled construction or in suspended tracks there is a need to supply electric power at an intermediate point in the track. This may not necessarily be at any end of a track section. The power connection to a track may be accomplished in accordance with this invention at any place along its length using the floating canopys of either FIGS. 12 through 14 or of FIG. 15. In FIG. 12 the floating canopy 126 is shown overlying a track 13, which track is intended for surface mounting on a ceiling. Since power is applied at an intermediate point, the ends of the tracks need not show and should not be exposed and therefore they are closed as illustrated in FIGS. 12 an 13 by end plugs 142. Viewing the track from below, a short tunnel-like structure 126 is all that is visible to the viewer.

In certain installations which are suspended from a ceiling as illustrated in FIG. 15, the canopy 120 without the side wings is used. Other than this mounting difference, the floating canopy of FIG. 15 is electrically identical with that of FIGS. 12–14. In this case, the track 13 shown at both ends of canopy 120 and the canopy 120 are suspended from a tubular support 121 which carries the power conductors through its interior to the ceiling. Mechanical support and decorative appearance is enhanced by plate 122 and closes the electrical outlet box, unshown in FIG. 15.

Referring again to FIGS. 12 through 14, the floating canopy 126 includes a housing 127 with a pair of openings 130 at each end thereof dimensioned to receive the track 13 as shown in FIG. 12 with the center divider between the opening 130 filling the gap in the center of track 13.

Figure 13:
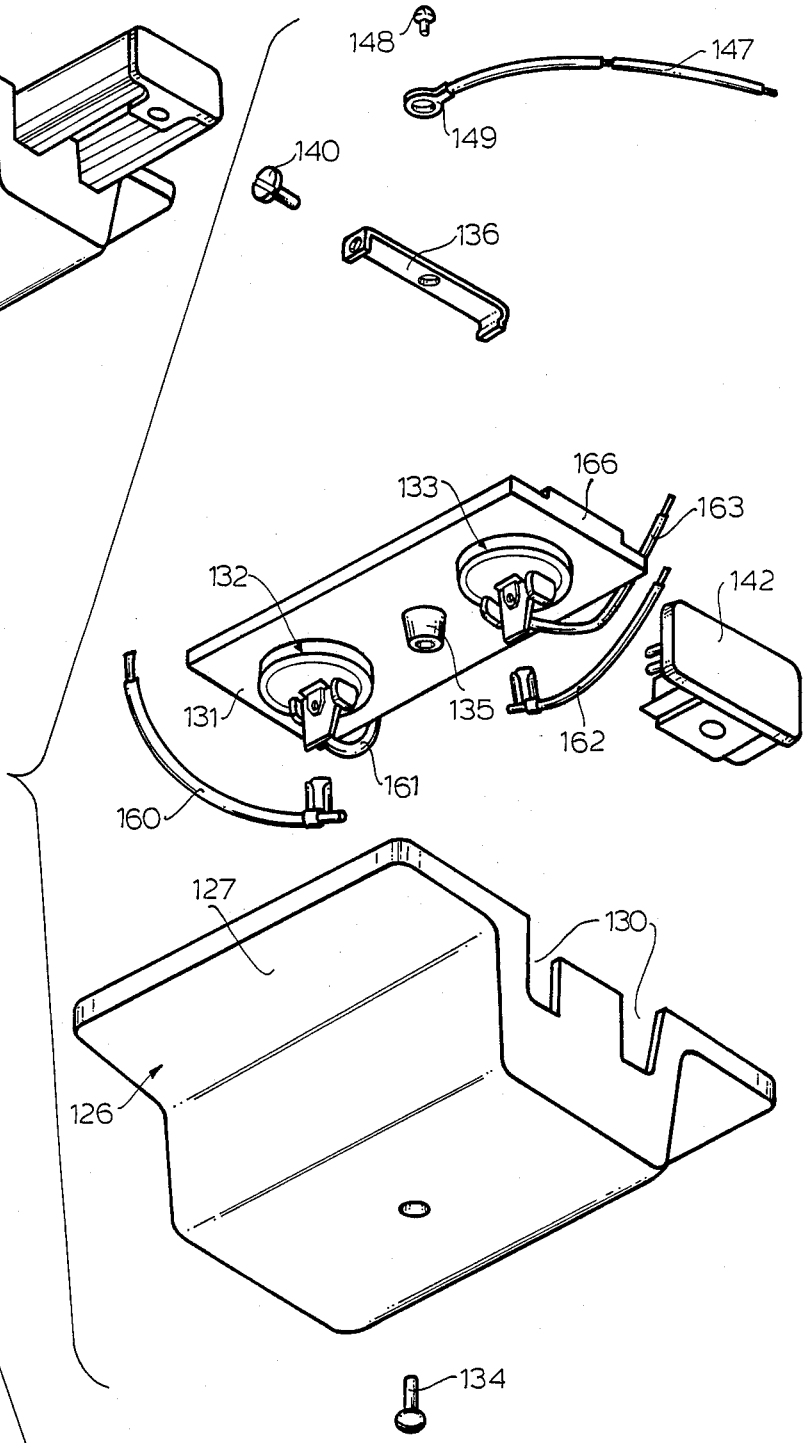
FIG. 13 is an exploded view thereof.
Figure 14:
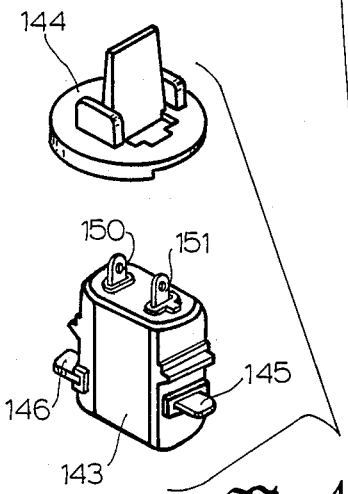
FIG. 14 is an exploded view of the power connection of FIG. 13.

Above the housing 127 is a plate 131 having a boss 135 through which a screw 134 is used to hold the housing 127 in place. The plate 131 mounts a pair of electrical connectors 132 and 133, one side of which appears in FIG. 13. These electrical connectors 132 and 133 may be more clearly seen in inverted form for clarity in FIG. 14. They are made up of a body 143 similar to the power connectors 40 if FIGS. 3 and 4 and a locking ring 144. The body 143 includes a pair of asymmetrically located electrical contacts 145 and 146 which are electrically connected to respective connectors 151 and 150 in a manner similar to that disclosed in FIG. 5. The body 143 extends through openings in the plate 131 and is held in place by the locking ring 144. Thus, as shown in FIG. 13, a pair of spaced connectors on each electrical connector 132 and 133 of the type shown in FIG. 14 as 150 and 151, are connected to lead wires 160, 161, 162 and 163. These four wires provide power for the two circuits and a ground to the track 13 is provided via a ground strap 136 which is secured to the upper side of the track by locking screw 140. A ground wire 147 is secured to the strap 136 by rivet 148 passing through circular lug 149.

Characteristic of this invention and particularly the floating canopy of FIGS. 12 through 15 is the fact that electrical connection to the two circuits is obtained merely by inserting the plate 131 in the track with the ridge 166 entering the recess of the track and with the two electrical connectors 132 and 133 aligned with the narrow faces at the recess edges of the track 13. Thereafter, both connectors 132 and 133 are rotated 90 degrees to bring the asymmetrical contacts of the type shown in FIG. 14 and 145 and 146 into engagement with two opposite conductors. In one embodiment, locking is accomplished by turning both connectors 132 and 133 in a clockwise direction 90 degrees. When this is done, electrical contactor 132 will have one terminal engaging the neutral conductor and line L1 of FIG. 6 and the electrical connector 133 will have one of its contacts engaging the other neutral wire and line L2. Because of the asymmetrical design, the connectors are polarized and no way can the circuits become crossed nor can one circuit fail to be energized. The floating company can be installed at any place along the length of the track.

SUMMARY

The foregoing constitutes a description of the best mode we know of providing dual independent reliable circuits in a single track lighting system with complete flexibility as to the position of powering of the track, position of any fixtures on the track and the load of either of the two or more circuits present in the track. A clear visible indication is given as to which fixtures are located electrically on which circuit and change of any fixture to the opposite or different circuit if accomplished in a foolproof manner by merely a 90 degree twist to unlock and remove the fixture 180 degree turn of its track adapter and a 90 degree turn of the track adapter to alectrically and mechanically secure the fixture, this time on the other or a different circuit. End and center feed connectors are disclosed as are track end connectors designed such that the electrical isolation of the multiple circuits is maintained and circuit continuity is maintained throughout the length of the track. A far greater degree of flexibility in track lighting systems is achieved employing this invention.

The foregoing constitutes a disclosure of the best mode known to us for carrying out this invention but is by no means limited to the embodiments illustrated. The scope of this invention is instead determined from the following claims and their equivalents.

We claim:

1. A multiple circuit track lighting system comprising:

an elongated track including a bottom opening and a pair of partial bottom walls at opposite sides of the track defining a pair of edge recesses;

insulating members within said edge recesses;

said insulating members each having a plurality of vertically separating recesses oppositely disposed with respect to those of the other insulating member;

an electrical conductor in each of said recesses with a portion of the surface of each conductor exposed to electrical contact within said track;

means for electrically connecting together one oppositely disposed pair of said conductors;

means for effecting separating electrical connections to each conductor of another oppositely disposed pair of said conductors;

connector means mechanically engageable with said track to be supported thereby and for supporting an electrical fixture to be powered by said track lighting system;

said connector means including vertically separated electrical contacts on opposite sides of said connector means;

said separated electrical contacts being positioned in said connector means so that one contact engages one conductor on one side of said track and the other contact engages a separated conductor on the opposite side of said track when said connector means is fully engaged with said track;

the orientation of said electrical contacts being such that when the connector means is reversed and engaged with the track, the contacts engage vertically separated conductors on opposite sides of the track;

whereby any fixture supported by said connector means may be transferred from one circuit to a different circuit in said track lighting system by a simple reversal of said connector means; and means for releasably latching said connector means in a position in which said electrical contacts are in engagement with said electrical conductors including a member carried by said connector means, spring urged into engagement with facing edges of the bottom opening of said track.

2. A track lighting system in accordance with claim 1 wherein said electrical conductors are positioned in vertically separated positions on each side of said track and said electrical contacts of said connector means are vertically separated corresponding to the vertical displacement of said conductors on each side of said track.

3. The combination in accordance with claim 2 including means for powering said track from positions selectable along its length comprising:

an elongated insulating body;

means for electrically connecting and mechanically securing said insulating body to said track at substantially any place alone its length;

said electrically connecting and mechanically securing means comprising a pair of track connectors each including a pair of electrical contact means positioned on said track connector to engage a pair of conductors in said track assembly on opposite sides thereof;

means for supplying power to said electrical contact means; and means mounting said track connectors on said elongated insulating body and extending into the bottom opening of said track for locking engagement with one track connector electrically engaging one pair of electrical conductors in said track and the other track connector electrically engaging the other pair of electrical conductors in said track.

4. The combination in accordance with claim 3 wherein said track connectors are bilaterally asymmetrically polarized whereby one of said track connectors may contact only one pair of conductors and the other of said track connectors may contact only the other pair of said conductors.

5. A track lighting system in accordance with claim 1 wherein said electrical conductors are located within said track at two vertically displaced planes, two conductors in each plane, one in each of said recesses.

6. A track lighting system in accordance with claim 1 including means for electrically connecting said conductors to two line circuits including common neutral conductor said electrically connecting means including electrical connection to one electrical conductor on each side of said track at a common level as the neutral and to a second vertically separated conductor at the opposite side of said track as the second line conductor.

7. A track lighting system in accordance with claim 6 wherein said common neutral conductor is constituted by a pair of electrical conductors asymmetrically placed on opposite sides of said track recess and wherein the pair of electrical conductors defining said common neutral conductor are located in the track above the remaining conductors.

8. A track lighting system in accordance with claim 1 wherein said track includes an additional pair of edge recesses, said pair of edge recesses defining mechanical support points for fixtures.

9. A track lighting system in accordance with claim 1 including a fixture adapter having grounding means engageable with said track at said pair of edge recesses;

said grounding means comprising outward extending conducting flanges on said fixture adapter;

said conducting flanges constituting the support for a fixture from said track.

10. The combination in accordance with claim 1 including a track connector comprising an insulating body configured to enter said track recesses from an end thereof;

said track connector including a plurality of side extending conductor members positioned to engage respective conductors and including separate conductor means positioned to extend into electrical contact with said opposed mating recesses to electrically connect track sections together when said track connector inserted in the adjacent ends of track sections;

said side extending conductor members each having a pair of side wings extending out of said insulating body at two longitudinal positions but at the same vertical level whereby electrical interconnection between conductors at the same level and adjacent track sections may be electrically interconnected;

said body maintaining each of said side extending conductor members electrically insulated from each other side extending conductor member whereby isolation of each circuit is maintained from track section to track section.

11. The combination in accordance with claim 10 wherein said side extending conductor members are enclosed within said insulating body with each of said conductor members including a pair of longitudinally spaced wings with spacing therebetween sufficient that one wing contacts each of two end abutting track sections.

12. A multiple circuit track lighting system comprising:

a conductive track defining a downward opening recess having an opening for receiving fixtures to be powered from said track;

two pairs of electrical conductors in said track;

means connecting together one of said pairs of conductors to constitute the same a common neutral of a plurality of electrical circuits;

means positioning said pairs of electrical conductors with one conductor of each pair symmetrically positioned with respect to the other conductor of the same pair; the different pairs having opposite symmetry whereby an electrical connector connected to one asymmetrical pair, when positioned in said recess is connectable to the opposite pair when its symmetry is reversed; means for supplying power to said track comprising;

an insulating body;

said body including an end configured to enter an end of said track in said recess;

said insulating body mounting electrical contact means for engaging conductors within said track at one asymmetrical position and electrical contact means for engaging conductors within said track at a different asymmetrical position;

means mounted on said body making grounding electrical contact with said track whereby two line circuits plus electrical ground are established in said track;

said grounding electrical contact making means comprising a spring element within said insulating body including a pair of side wings each extending out of said insulating body and engaging said track at the opening of said downward opening recess;

bifurcated spring contact means mounted on said body with end portions extending laterally in opposite directions for simultaneously engaging a pair of conductors in opposite sides of said track;

second and third spring contact means;

said body securing said second and third spring contact means for side electrical contact each with a respective conductor within said track.

13. The combination in accordance with claim 12 wherein said body defines a plurality of recesses with side wall openings and wherein said contact means extend through respective side openings in the opposite sides of said body to make contact with said track and its conductor.

* * * * *